US005381903A

United States Patent [19]

Hardenne

[11] Patent Number: 5,381,903

[45] Date of Patent: Jan. 17, 1995

[54] PACKAGING SYSTEM

[76] Inventor: Anthony Hardenne, 718 - 2nd Avenue N., Saskatoon, Saskatchewan, Canada, S7K 2E1

[21] Appl. No.: 84,153

[22] Filed: Jul. 1, 1993

[51] Int. Cl.[6] ..... B65D 85/00

[52] U.S. Cl. ..... 206/526; 206/499; 53/447; 53/540

[58] Field of Search ..... 206/321, 322, 386, 499, 206/526; 53/155, 447, 540, 541

[56] References Cited

U.S. PATENT DOCUMENTS

| | | | |
|---|---|---|---|
| 2,969,629 | 1/1961 | Blais | 53/155 |
| 3,117,692 | 1/1964 | Carpenter et al. . | |
| 3,493,106 | 2/1970 | Galli | 206/497 |
| 3,986,611 | 10/1976 | Dreher | 206/497 |
| 4,262,605 | 4/1981 | Sokol . | |
| 4,300,685 | 11/1981 | Stern | 206/526 |
| 4,621,716 | 11/1986 | Reinäcker . | |
| 4,763,787 | 8/1988 | Koenig . | |
| 4,793,490 | 12/1988 | Evert | 206/497 |
| 4,852,330 | 8/1989 | Carangelo | 206/83.5 |
| 4,913,290 | 4/1990 | deGroot | 206/597 |
| 5,012,923 | 5/1991 | Hayes . | |

OTHER PUBLICATIONS

Patterson et al., IBM Technical Disclosure Bulletin, "Modular Cartons for Maximum Cube Utilization", Oct. 1977, vol. 20, No. 5.

*Primary Examiner*—David T. Fidei

*Attorney, Agent, or Firm*—Murray E. Thrift; Adrian D. Battison; Stanley G. Ade

[57] ABSTRACT

A packaging system for packaging individual objects, for example confectioneries such as chocolates includes an outer container for shipping various combinations of inner containers, themselves containing the objects in a number proportional to their external volumes. The dimensions and external volumes of the., inner containers are so related that the outer canon can be filled with almost any combination of the inner containers housing the total number of objects to be shipped in the outer container. This eliminates inventory problems with slow moving package sizes.

16 Claims, 5 Drawing Sheets

PACKAGING SYSTEM

FIELD OF THE INVENTION

The present invention relates to packaging and has particular utility in the packaging of confectionery products, for example chocolates.

BACKGROUND

For retail sales purposes, confections are often packaged in boxes, each containing a specified net weight of the confections. For example, with chocolates ¼ lb., ½ lb., 1 lb. and 2 lb. net weight boxes are common sizes. The retailer ordering these confections must order a complete case of the retail boxes, because that is how they are packaged. This creates inventory problems with slow moving sizes and discourages the retailer from carrying anything but the most popular sizes of retail package.

The present invention addresses this concern and aims at the provision of a system that will allow the retailer to order only those container sizes and quantifies that are appropriate for the individual retailer's trade.

SUMMARY

With the present invention, the packaging system includes sets of containers of different sizes that may be assembled in a large number of combinations to fill an outer shipping container of a predetermined size.

According to one aspect of the present invention there is provided a packaging system comprising:

an outer container having a rectangular interior with predetermined internal lateral length and width dimensions and a predetermined internal height dimension:

a plurality of rectangular inner containers, each with predetermined lateral length and width dimensions and a predetermined height dimension, the inner containers being in plural sets with the containers of each set having common dimensions and differing in at least one dimension from the containers of each other set, the different lateral dimensions of the containers being related to one another by integral factors, and different height dimensions of the containers being related to one another by integral factors.

Plural smaller inner containers can thus be assembled into the same space as a larger inner container, thus providing considerable flexibility in the packaging of a variety of container sizes for transport.

According to another aspect of the present invention there is provided a packaging system for packaging a predetermined number of individual objects, said system comprising: a plurality of sets of rectangular inner containers, the inner containers of each set being of the same shape and external volume, and differing at least in external volume from the inner containers of each other set, the different external volumes of the containers being related by integral factors i.e. whole numbers greater than zero, the inner containers containing the individual objects in numbers that are proportional to the external volumes of the inner containers; and an outer rectangular container having a predetermined internal volume that is an integral multiple of the external volume of each inner container whereby all combinations of the inner containers that will fill the outer container will contain, in total, the same number of said objects.

By proportioning the contents of the inner containers according to their external volumes, the contents of the outer container will always be the same when it is filled. Thus, with chocolates, a retailer ordering one carton will always get the same number of chocolates, regardless of the combination of box sizes specified in the order.

According to a further aspect of the present invention there is provided a packaging system for packaging individual objects, comprising:

a set of rectangular first containers, each first container having lateral dimensions W and aW and a height H where a is an integer, each first container containing a number N of said objects;

a plurality of additional sets of rectangular containers, the containers of each set being of the same size and differing in size from those of the other sets, each container of each additional set having lateral dimensions bW and cW and a height dimension dH, where, b, c and d are integers, and each container containing ($b \times c \times d \times N$) of said objects.

BRIEF DESCRIPTION OF THE DRAWINGS

In the accompanying drawings, which illustrate an exemplary embodiment of the present invention.

DETAILED DESCRIPTION

Figure 1:
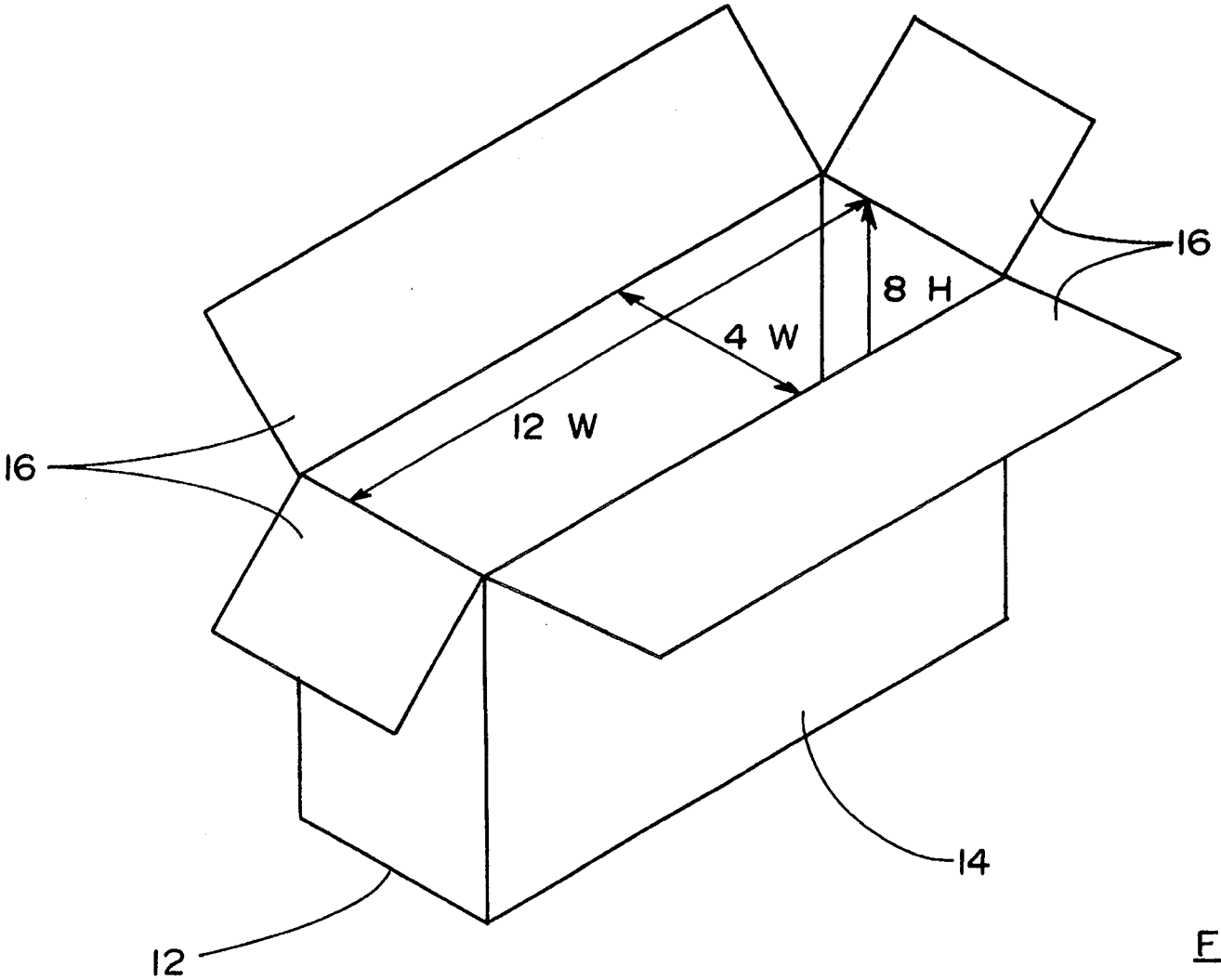
FIG. 1 is an isometric view of an outer container or a carton.

Referring to the accompanying drawings, FIG. 1 illustrates an overall package 10 according to the present invention. This includes an outer container in the form of a rectangular carton 12 with a body 14 and a set of cover flaps 16 for closing the carton. As illustrated in FIG. 1, the carton has, internally, a length 12W, a width 4W and a height 8H, which are internal dimensions.

Figure 2:
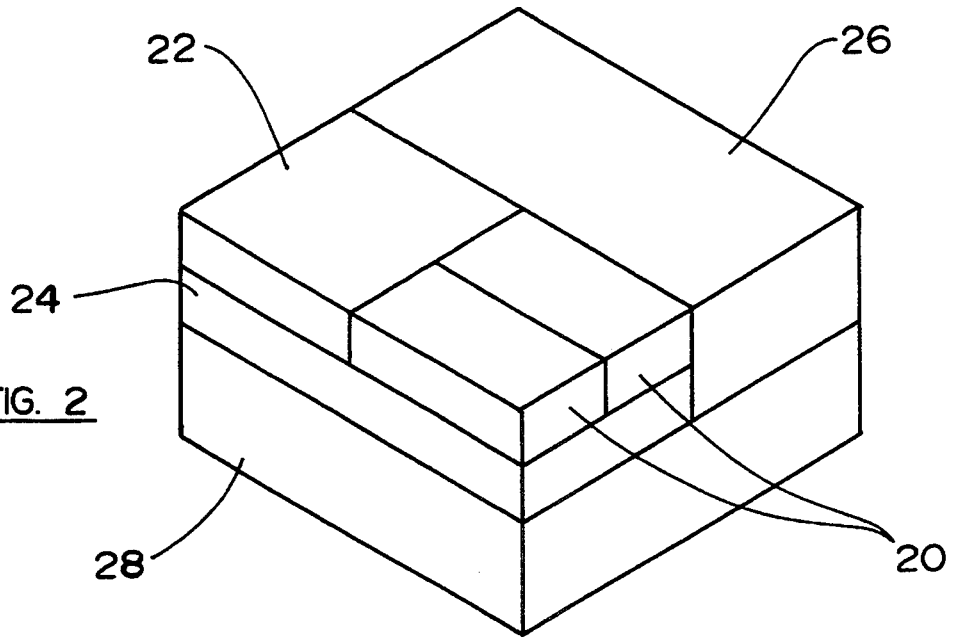
FIG. 2 is an isometric view of one assembly of inner containers.

FIG. 2 illustrates an assembly of inner containers for boxes that will partially fill the carton 12. The individual containers are themselves illustrated in FIGS. 3 through 7. In the present example, these boxes are intended to carry individual chocolates.

Figure 3:
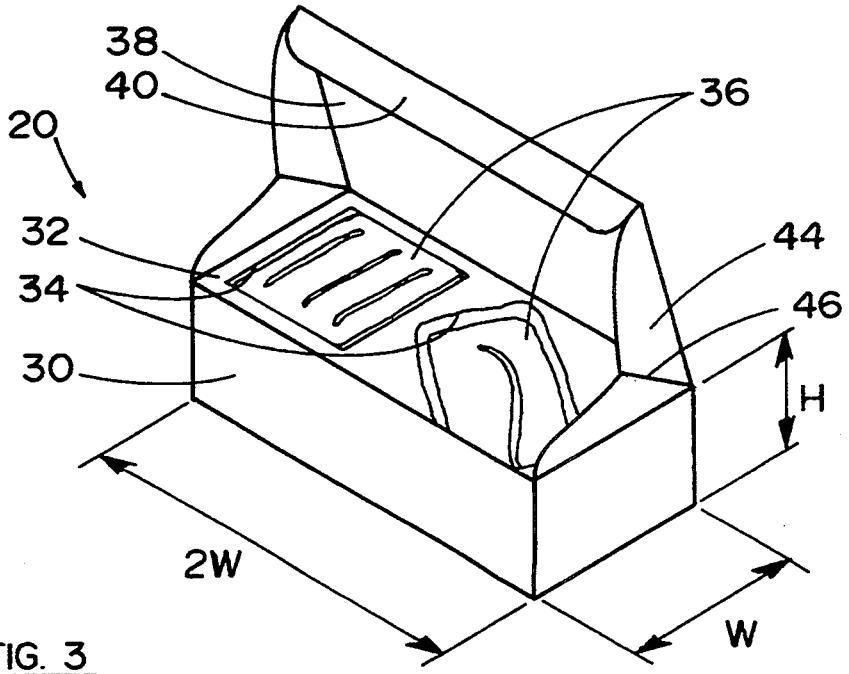
FIGS. 3 through 7 illustrate inner containers of boxes of various sizes to make up the system illustrated in FIGS. 1 and 2.

FIG. 3 illustrates a rectangular box 20 with external length and width dimensions 2W and W, and an external height H.

Figure 4:
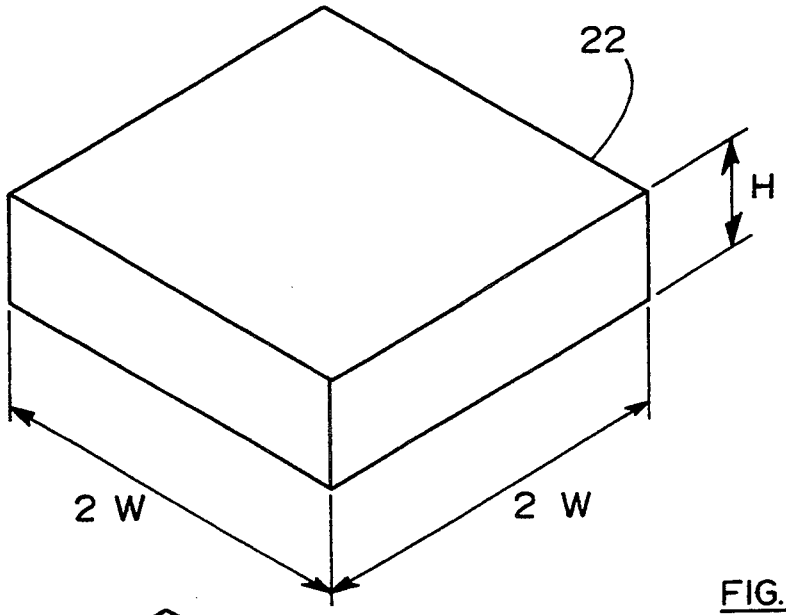

FIG. 4 illustrates a box 22 with external length and width dimensions 2W and 2 W and an external height dimension.

Figure 5:
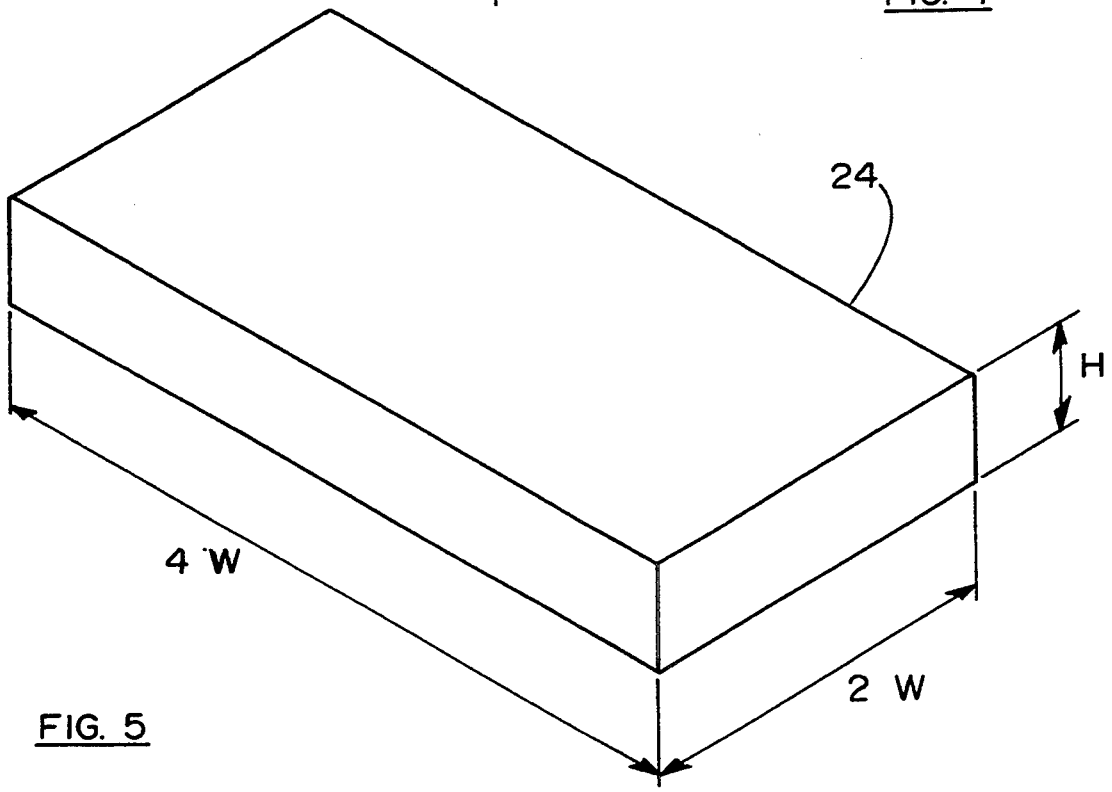

In FIG. 5, the illustrated box 24 has a height dimension H, a width dimension 2 W and a length dimension 4 W.

Figure 6:
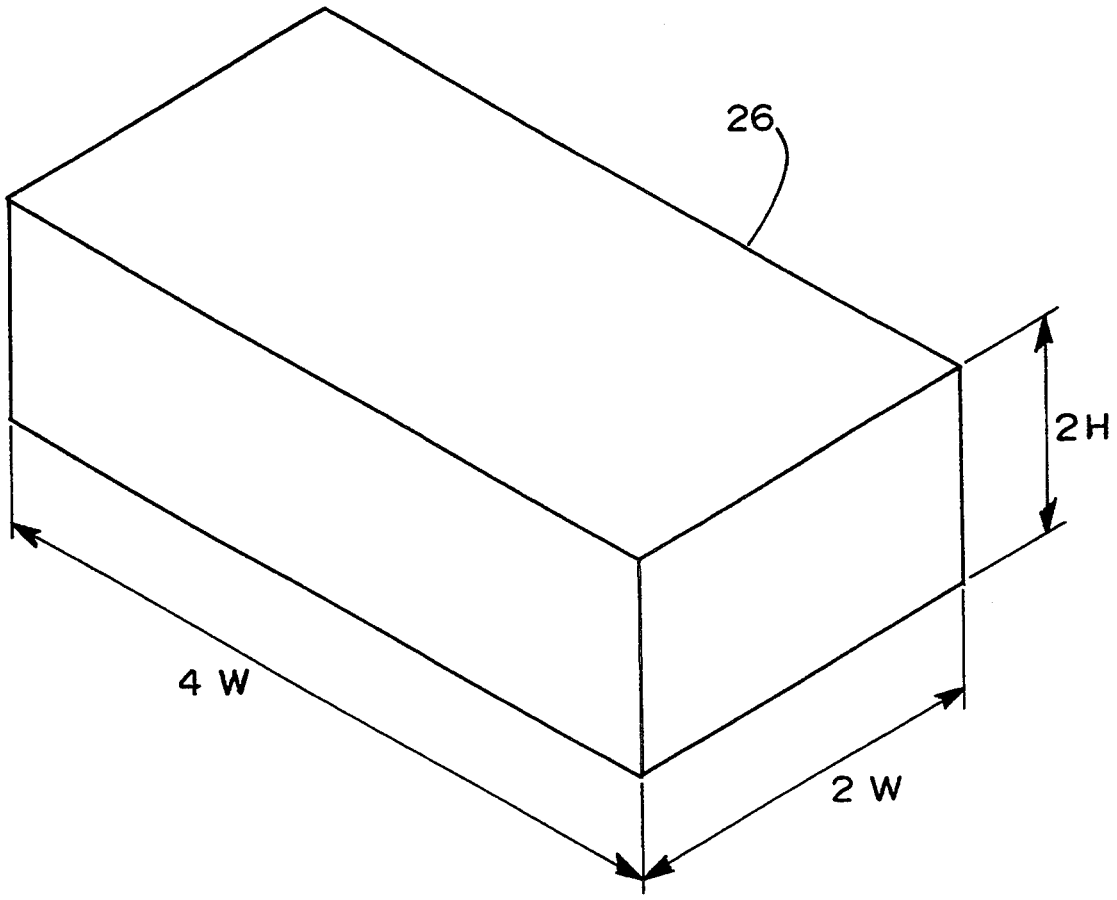

The box 26 illustrated in FIG. 6 has the same length and width dimensions as box 24 and a height 2H.

Figure 7:
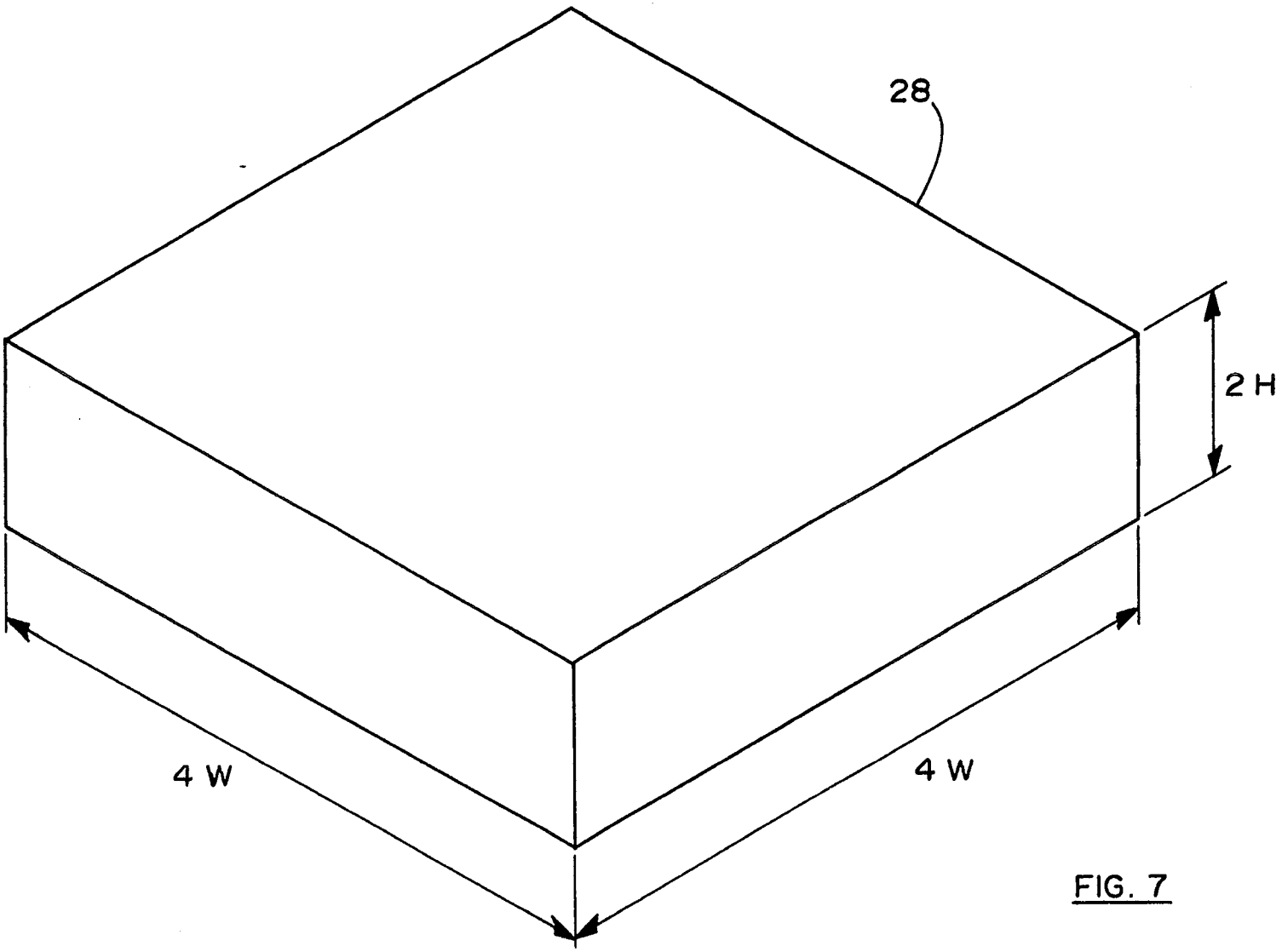

FIG. 7 illustrates the largest of the boxes. This has length and width dimensions 4W and a height 2H.

Given the dimensions of the boxes, it will be readily apparent that the length and width dimensions of the boxes are all related by integral factors. More specifically, they are related by a factor of 2 or a multiple thereof. Similarly, the different height dimensions are related by integral factors, in this case the factor being 2.

Similarly, the external volumes of the containers are related by integral factors, and particularly by a factor of 2 or multiples thereof. Thus, box 22 has twice the volume of box 20, box 24 has twice the volume of box 22, box 26 has twice the volume of box 24 and box 28 has twice the volume of box 26.

Because of this relationship amongst the external dimensions and the volumes of the boxes, they can be arranged in most any combination inside the outer carton 12. The partial assembly shown in FIG. 2 contains two boxes 20, a single box 22, a single box 24, a single box 26 and a single box 28. As will be apparent, it may also contain two boxes 28 or thirty-two boxes 20.

As illustrated most particularly in FIG. 3, each of the inner boxes 20 through 28 includes a base 30 of a rectangular shape containing an inner formed liner 32, The liner is formed with a number of pockets 34 to contain the individual chocolates 36. With the box 20, the liner is formed to hold two chocolates 36. Box 22 contains four chocolates, while box 24 contains eight chocolates. In box 26, there are sixteen chocolates in two layers. Box 28 contains thirty-two chocolates in two layers. This arrangement of the chocolates means that the number of chocolates in each container is proportional to the external volume of the container. It also means that no matter what combination of the boxes is used to fill the outer canon 12, the same number of chocolates will be included in the outer canon. In the present case, this is 384 chocolates.

Reverting to FIG. 3, each individual inner box is equipped with a cover flap 38 with a tuck in edge flap 40. The sides of the cover panel are connected to the sides of the box by side panels 42 with fold lines 44 extending across the side panels so they will fold into the box when the cover panel is closed.

The complete packaging system includes the outer container and a set of plural inner containers of each size. Inner containers are selected from the sets according to an order, and are stacked into the outer container for shipping and handling. A complete order must total 384 chocolates, but apart from that, there is no limit on what combination of inner containers can be ordered. The proportional relationship extends from the box size to the net weight of its contents as well. The five box sizes of the illustrated embodiment may thus contain 1 oz., 2 oz., 4 oz. ($\frac{1}{4}$ lb.), 8 oz. ($\frac{1}{2}$ lb.) and 16 oz. (1 lb.) net weight of chocolates respectively.

While one particular embodiment of the present invention has been described in connection with the packaging of chocolates, it is to be understood that other embodiments are possible and may be used for packaging other articles as well. The invention is therefore to be considered limited solely by the scope of the appended claims.

I claim:

1. A packaging system comprising an outer container and a plurality of inner containers smaller than the outer container, wherein:

the outer container has a rectangular interior volume with internal outer container dimensions including an outer container length and an outer container width, and an outer container height;

the plurality of inner containers includes at least three inner container sets, each set comprising at least one rectangular inner container having dimensions including an inner container length, an inner container width and an inner container height, with i) each of the containers of each inner container set having the same length, width and height dimensions, ii) the containers of each inner container set differing in at least one of the length, width and height dimensions from the containers of each other of the inner container sets, iii) the length and width dimensions of each inner container being related to one another by an integral factor, iv) the length and width dimensions of each inner container of each inner container set being related to the length and width dimensions of each inner container of each other inner container set by integral factors, v) the length and width dimensions of each inner container being related to the length and width dimensions of the outer container by integral factors, vi) the height dimension of each inner container of each inner container set, being related to the height dimension of each inner container of each other of the inner container sets by an integral factor, and vii) the height dimension of each inner container of each inner container set being related to the height dimension of the outer container by an integral factor.

2. A packaging system according to claim 1 wherein the length and width dimensions of each inner container are the same or are related by integral factors that are even numbers.

3. A system according to claim 2 wherein the height dimension of each inner container of each inner container set is related to the height dimension of each inner container of each other of the inner container sets by an integral factor that is one or an even number.

4. A packaging system according to claim 1 wherein each inner container of each inner container set has a volume that is related to the volume of each inner container of each other of the inner container sets by an integral factor that is an even number.

5. A system according to claim 1 including five sets of inner containers.

6. A packaging system according to claim 1 for packaging a number of individual objects, wherein each inner container has an external volume and each inner container contains the individual objects in a number that is proportional to the external volume of the inner container.

7. A system according to claim 6 wherein the length and width dimensions of each inner container are the same or are related by integral factors that are even numbers.

8. A system according to claim 7 wherein the height dimension each inner container of each inner container set is related to the height dimension of each inner container of each other of the inner container sets by an integral factor of 2 or a multiple thereof.

9. A system according to claim 1 wherein the sets of inner containers include a first set of first containers, each first container having a width dimension W, a length dimension 2W and a height dimension H.

10. A system according to claim 9 wherein the sets of inner containers include a second set of second containers, each second container having a width dimension 2W, a length dimension 2W and a height, dimension H.

11. A system according to claim 10 wherein the sets of inner containers include a third set of third containers, each third container having a width dimension 2W, a length dimension 4W and a height dimension H.

12. A system according to claim 11 wherein the sets of inner containers include a fourth set of fourth containers, each fourth container having a width dimension 2W, a length dimension 4W and a height dimension 2H.

13. A system according to claim 12 wherein the sets of inner containers include a fifth set of fifth containers, each fifth container having a width dimension 4W, a length dimension 4W and a height dimension 2H.

14. A packaging system according to claim 2 wherein the length and width dimensions of each inner container of each inner container set are related to the length and width dimensions of each inner container of each other of the inner container sets by integral factors that are one or even numbers.

15. A packaging system according to claim 14 wherein the length and width dimensions of each inner container of each inner container set are related to the length and width dimensions of the outer container by integral factors that are one or even numbers.

16. A packaging system according to claim 3 wherein the height dimension of each inner container of each inner container set is related to the height dimension of the outer container by an integral factor that is one or an even number.

* * * * *